US005213612A

United States Patent [19]

Minnear et al.

[11] Patent Number: 5,213,612

[45] Date of Patent: May 25, 1993

[54] METHOD OF FORMING POROUS BODIES OF MOLYBDENUM OR TUNGSTEN

[75] Inventors: William P. Minnear, Niskayuna; Bernard P. Bewlay, Schenectady, both of N.Y.

[73] Assignee: General Electric Company, Schenectady, N.Y.

[21] Appl. No.: 777,943

[22] Filed: Oct. 17, 1991

[51] Int. Cl.[5] ..... B32B 5/18

[52] U.S. Cl. ..... 75/415; 75/623; 264/65; 428/613

[58] Field of Search ..... 501/84, 94; 264/65, 264/DIG. 48; 428/613; 75/415, 623; 419/2

[56] References Cited

U.S. PATENT DOCUMENTS 3,833,386 9/1974 Wood et al. ..... 106/41

4,981,820 1/1991 Renlund et al. ..... 501/39

*Primary Examiner*—Mark L. Bell

*Assistant Examiner*—Chris Gallo

*Attorney, Agent, or Firm*—James E. McGinness; James Magee, Jr.

[57] ABSTRACT

A method for forming a porous body of a metal from the group consisting of molybdenum, molybdenum alloy, tungsten, tungsten alloy, or mixtures thereof comprises foaming a mixture of a sinterable powder of the metal and a foaming agent in a volume ratio of about 0.6 to 3.5:1 respectively, to form a foam having the metal powder dispersed therein. The foam is heated in a reducing atmosphere that promotes interparticle diffusion and bonding, to decompose the foam and sinter the metal powder to form the porous body.

4 Claims, No Drawings

METHOD OF FORMING POROUS BODIES OF MOLYBDENUM OR TUNGSTEN

BACKGROUND OF THE INVENTION

This invention relates to a method of forming a porous body of molybdenum, molybdenum alloy, tungsten, or tungsten alloy.

A method for forming porous ceramic structures is disclosed in U.S. Pat. No. 3,833,386. An isocyanate capped polyoxyethylene polyol is reacted with large amounts of an aqueous slurry of sinterable ceramic material. A hydrophilic crosslinked polyurethane foam is generated having sinterable material uniformly disposed throughout. The foamed structure is heated in an atmosphere of air, oxygen, inert gases or the like to decompose the polyurethane and sinter the remaining sinterable ceramic material forming a rigid ceramic foam structure. In addition, it is disclosed that metal systems such as aluminum powder, or nickel powder along with a binder, fluxing agent and a liquid carrier can be reacted with the isocyanate capped polyoxyethylene polyol to form the foamed structure.

U.S. Pat. No. 4,981,820 discloses a method in which select silicone resins can be mixed with a solvent, a foaming agent such as the isocyanate capped polyoxyethylene polyol, and sometimes a curing agent for crosslinking the resin. The foaming agent is reacted to form a carrier foam with the resin disposed throughout the foam as a continuous separate phase. Solvent and excess water are removed from the foam by drying, and the resin is crosslinked after the foam forms so that the resin retains the foamed structure. After the resin has crosslinked, the carrier foam is removed by decomposition. The remaining foamed resin structure is heated in a non-oxidizing atmosphere to pyrolize the resin, and the pyrolizing resin densifies to form a cellular glass structure.

It is an object of this invention to provide a method for forming metallic porous bodies of molybdenum, molybdenum alloy, tungsten, tungsten alloy, or mixtures thereof.

It is an object of this invention to provide a method for forming the metallic porous bodies that does not require the use of metal powder binders or fluxing agents.

BRIEF DESCRIPTION OF THE INVENTION

A method for forming a porous body of a metal from the group consisting of molybdenum, molybdenum alloy, tungsten, tungsten alloy, or mixtures thereof comprises foaming a uniform mixture of a sinterable powder of the metal and a foaming agent in a volume ratio of about 0.6 to 3.5:1, respectively, to form a foam having the powder dispersed therein. The foam is heated in a reducing atmosphere that promotes interparticle diffusion and bonding, to decompose the foam and sinter the metal powder to form the porous body. Preferably, the heating is at a rate of about 80° C. per minute or less, and the metal powder has a particle size of about 10 microns or less.

As used herein, the term "reducing atmosphere that promotes interparticle diffusion and bonding" means an atmosphere that will remove reaction products from the decomposing foam, and promote diffusion between powder particles to provide interparticle bonding. Examples of such reducing atmospheres are hydrogen, inert atmospheres such as argon or nitrogen mixed with hydrogen, and the above atmospheres having a partial pressure of water vapor.

A suitable foaming agent is the isocyanate capped polyoxyethylene polyol reaction product having an average isocyanate functionality greater than 2 and up to about 6 or more. Methods for making and foaming such isocyanate capped polyoxyethylene polyol reaction products are disclosed in U.S. Pat. No. 3,833,386, incorporated by reference herein.

DETAILED DESCRIPTION OF THE INVENTION

The method of this invention provides porous structures of molybdenum, molybdenum alloy, tungsten, tungsten alloy, or mixtures thereof having density as low as about 10 to 20 percent of theoretical density for the fully densified metal body. Such low density metal bodies are useful for thermal shielding in high temperature furnaces, as molten metal filters, or gas filters. For example, a resistance heating furnace having a tungsten heating element is capable of heating up to about 2500° C. Sheets of molybdenum or tungsten spaced in packs provide thermal shielding of the heating element, and reduce the rate of heat loss from the element to the furnace walls. For example, cylindrical furnaces have spaced cylinders of molybdenum or tungsten sheeting to provide the thermal shielding. The porous bodies of this invention provide thermal shielding that is readily formed in a variety of shapes such as cylinders, or plates by the method of this invention.

Metal powder can be mixed with the foaming agent in at least a ratio that will form a self-supporting powder structure when the foam has been decomposed, up to an amount that does not substantially suppress the foaming action. A suitable ratio of metal powder to foaming agent was found to be a volume ratio of 0.6 to 3.5:1, respectively. The upper limit of the solid powder loading is dependent upon the powder particle size, i.e., the higher ratios of powder loading can be achieved with larger particle sizes. Water can be mixed with the foaming agent in a volume ratio of about 1 to 5.5:1, respectively, to provide the foaming reaction.

A sinterable metal powder is mixed with the foaming agent and water. As the metal powder particle size increases, resistance to interdiffusion between particles increases, and neck formation and particle coalescence is inhibited so that the particles do not sinter. As used herein, the term a "sinterable metal powder" is a powder having a particle size that allows interparticle diffusion and densification without complete melting of the particles. We have found that molybdenum or tungsten powders having an average particle size up to about 10 microns, preferably up to about 5 microns are sinterable.

Foaming can be accomplished by mixing the metal powder with the foaming agent and adding water to react the foaming agent, or by forming an aqueous suspension of the metal powder that is mixed with the foaming agent. For example, the foaming agent is dissolved in a solvent and mixed with the powder. The foaming agent can be dissolved in a nonpolar organic solvent, such as toluene, acetone, freon or methylene chloride. The nonpolar organic solvent is present in an amount that will at least dissolve the foaming agent up to an amount that does not dilute the foaming agent so that it does not foam properly, such amounts of solvent are about 10 to 50 weight percent of the foaming agent.

The metal powder is mixed with the dissolved foaming agent and water is added to start the foaming action. It should be understood that some foaming action can be initiated when the powder is mixed with the foaming agent due to hygroscopic water on the particles. As a result, the powder should be mixed with the foaming agent in an expeditious manner so that the water can be added before substantial foaming begins.

Alternatively, an aqueous suspension of metal powder is formed by mixing the powder of molybdenum, molybdenum alloy, tungsten, tungsten alloy, or mixtures thereof in water. Preferably, the metal powder has a fine particle size that promotes the formation of the suspension, for example, an average particle size of about 10 microns or less. Surfactants can be added to the water to improve suspension of the metal powder in the water. Suitable surfactants are the commercially available "Pluronic" polyols such a P84 or L93. The synthesis of "Pluronic" polyol surfactants manufactured by BASF Wyandotte Corporation is initiated by the controlled addition of propylene oxide to the two hydroxyl groups of a propylene glycol initiator. The resulting hydrophobe can be tailored to any desired length, varying from 800 to several thousands in molecular weight. A block copolymer is formed between the hydrophobic ethylene oxide base and the hydrophylic polyoxyethylene groups which are controlled in length to constitute from 10 percent to 80 percent by weight of the final molecule.

Surfactants may be added in amounts up to about 5 weight percent of the suspension. For example, a suspension can be formed in a tumbling mill by adding in the following order; the water, surfactant, and metal powder. For example, molybdenum powder having an average particle size of about 3 microns can be added from about 32 to 35 volume percent, and tungsten powder having an average particle size of about 4.5 microns can be added from about 22 to 25 volume percent of the aqueous suspension, with about 5 percent surfactant.

The suspension is mixed with the foaming agent, for example by stirring in a beaker, and the mixture is cast into a mold. Water in the suspension reacts with the foaming agent to form a hydrophilic crosslinked polyurethane foam. The polyurethane foam acts as a carrier for the metal powder so that the powder is uniformly disposed throughout the polyurethane foam. The temperature of the aqueous suspension and foaming agent can be controlled with higher temperatures causing the foaming action to increase and produce a larger cell size in the foam. Sufficient foaming occurs with mixture temperatures of 0° C. to 95° C. Because the foaming reaction is exothermic, the mixture temperature increases after foaming begins.

The foamed structure is dried to evaporate liquid. Drying can be conducted from room temperature to about 150° C. The dried foam is then heated to decompose the polyurethane foam and sinter the remaining metal powder to form the porous structure. Heating is performed in a reducing atmosphere, for example, a flowing hydrogen atmosphere having a dew point between about −70° to 25° C.

Sintering of the metal powders occurs at temperatures much higher than the decomposition temperature of the foam. For example, the polyurethane foam can be decomposed below about 600° C., while molybdenum powder can be sintered at about 800° C. or higher, and tungsten powder can be sintered at about 1200° C. or higher. However, the unsintered metal powder must be supported in the foamed structure when the polyurethane foam has been decomposed. We have found that by heating in a reducing atmosphere, sufficient interparticle diffusion and bonding occurs to prevent the foamed metal powder from collapsing after the polyurethane foam has been decomposed and no longer supports the powder. In addition, we have found that powder particles having an average particle size of about 10 microns or less have surface asperities which promote mechanical bonding of the powder particles so that the powder retains the foam structure without collapsing when the polyurethane foam has been decomposed but the powder has not been sintered.

Heating is performed at a rate that permits decomposition products to escape from the foam, and sufficient interparticle diffusion to bond the metal powder particles occurs before the foamed structure collapses. Heating rates of about 80° C. per minute, preferably about 40° C. per minute or less are suitable. Higher heating rates cause insufficient sintering before the polyurethane foam is decomposed and the porous metal structure collapses. Heating can be performed in steps to first decompose the foam, followed by sintering. For example, the foam can be heated at 2° C. per minute to about 600° C., held at 600° C. for 2 hours to provide for decomposition of the polyurethane foam, followed by heating to the sintering temperature at a rate of about 3° C. per minute.

The foamed structure is heated to the sintering temperature for the metal powder. Sintering temperature is affected by powder particle size, e.g., molybdenum powders can be sintered at about 800° to 1100° C., and tungsten powders can be sintered at about 1200° to 1500° C. Powders having finer particle sizes can be sintered at the lower temperatures. Enhanced sintering can be achieved by heating at temperatures up to about 1850° C. The foamed structure is heated to the sintering temperature for sufficient time to sinter the powder particles. Suitable hold time at 1400° C. is about 4 hours, and at 1800° C. is about 1 hour. A porous metal body is provided having a density as low as about 10 to 20 percent of the theoretical density of the fully densified metal. The method of this invention for foaming and heating metal powder in a reducing atmosphere provides a porous metal body without the need for binders and fluxes for the metal powder as disclosed in the '386 patent.

Additional features and advantages of the method of this invention are further shown in the following examples. In the following examples the foaming agent is Hypol 2000 isocyanate capped polyoxyethylene polyol, obtained from W. R. Grace & Co., Massachusetts.

EXAMPLE 1

An aqueous suspension of molybdenum powder was formed by mixing in a tumbling mill 170 grams of water, 2.4 grams of Pluronic P84, 6.32 grams of Pluronic L63, and 960 grams of molybdenum powder having an average particle size of about 2.8 microns. The aqueous suspension was mixed with 98 grams of foaming agent, forming a mixture comprised of about 35 volume percent molybdenum. The mixture was cast into a mold about 30.5 by 10.2 by 7.6 centimeters and foamed to rise in height about 3.8 centimeters. The foam casting was allowed to cure and dry over a period of about 24 hours, and was removed from the mold. The dried foam was heated to 1200° C. in an atmosphere of flowing hydrogen having a dew point of 25° C. in 90 minutes, held at 1200° C. for 30 minutes, heated to 1400° C. in 15 minutes, held at 1400° C. for 4 hours, and cooled to room temperature. A porous molybdenum body was formed having a density of about 1.33 grams per cubic centimeter.

EXAMPLE 2

A foamed casting was prepared according to the method in Example 1, and heated in an atmosphere of flowing hydrogen having a dew point of about 25° C. to 1200° C. in 90 minutes, held at 1200° C. for 30 minutes, heated to 1850° C. in 60 minutes, held at 1850° C. for 120 minutes, and cooled to room temperature. A porous molybdenum body was formed having a density of about 1.6 grams per cubic centimeter.

EXAMPLE 3

An aqueous suspension of molybdenum powder was formed by mixing 44.3 grams of water, 0.625 grams of Pluronic P84, 1.63 grams of Pluronic L63, and 250 grams of molybdenum powder having an average particles size of about 4 microns. The aqueous suspension was mixed with 25.5 grams of the foaming agent, and the mixture was cast into a cylindrical mold about 15.2 centimeters high, 8.3 centimeters in diameter, and having a rod 4.4 centimeters in diameter positioned in the mold axis. A cylindrical foamed molybdenum casting with a wall thickness of about 1.9 centimeters was formed.

The cylindrical casting was heated in a flowing hydrogen atmosphere having a dew point of 25° C. to 1200° C. in 2 hours, held at 1200° C. for 1 hour, heated to 1825° C. in 1 hour, held at 1825° C. for 2 hours, and cooled to room temperature. A porous sintered molybdenum cylindrical body was formed having a density of about 1.9 grams per cubic centimeter.

EXAMPLE 4

An aqueous suspension of tungsten powder was formed by mixing 170 grams of water, 2.43 grams of Pluronic P84, 6.38 grams of pluronic L63, and 960 grams of tungsten powder having an average particle size of about 4.5 microns. The aqueous suspension was mixed with 95.88 grams of the foaming agent for about 90 seconds and cast into a rectangular mold about 10.2 centimeters wide by 30.5 centimeters long. The mixture foamed and rose to a height of about 3.45 centimeters.

The casting was heated in a flowing hydrogen atmosphere having a dew point of 25° C. to 600° C. in 6 hours, held at 600° C. for 2 hours, heated to 1850° C. in 5 hours, held at 1850° C. for 6 hours, and cooled to room temperature. A porous sintered tungsten body was formed having a density of about 1.74 grams per cubic centimeter.

What is claimed is:

1. A method for forming a porous body of a metal from the group consisting of molybdenum, molybdenum alloys tungsten, tungsten alloys or mixtures thereof comprising:

foaming a mixture of a sinterable powder of the metal and a foaming agent in a volume ratio of about 0.6 to 3.5:1 respectively, to form a foam having the metal powder dispersed therein; and heating the foam in a reducing atmosphere that promotes interparticle diffusion and bonding, to decompose the foam and sinter the metal powder to form the porous body.

2. A method according to claim 1 wherein the powder has a particle size of about 10 microns or less.

3. A method according to claim 2 wherein the heating is at a rate of about 80° C. per minute or less.

4. A method according to claim 3 wherein the reducing atmosphere is flowing hydrogen having a dew point of about −70° to 25° C.

* * * * *